US009741481B2

(12) United States Patent
Rigling

(10) Patent No.: US 9,741,481 B2
(45) Date of Patent: Aug. 22, 2017

(54) ELECTROMAGNETIC ACTUATING MECHANISM

(71) Applicant: ETO Magnetic GmbH, Stockach (DE)

(72) Inventor: Timo Rigling, Moos (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 15/107,651

(22) PCT Filed: Dec. 18, 2014

(86) PCT No.: PCT/EP2014/078547

§ 371 (c)(1),
(2) Date: Jun. 23, 2016

(87) PCT Pub. No.: WO2015/097068

PCT Pub. Date: Jul. 2, 2015

(65) Prior Publication Data

US 2016/0322146 A1 Nov. 3, 2016

(30) Foreign Application Priority Data

Dec. 23, 2013 (DE) ..... 10 2013 114 830

(51) Int. Cl.
*H01F 7/00* (2006.01)
*H01F 7/121* (2006.01)
(Continued)

(52) U.S. Cl.
CPC ..... *H01F 7/121* (2013.01); *F01L 13/0036* (2013.01); *H01F 7/13* (2013.01);
(Continued)

(58) Field of Classification Search
CPC ..... H01F 7/1646; H01F 7/121; F01L 25/08; F01L 1/34; F01L 1/14; F01L 9/04
(Continued)

(56) References Cited

U.S. PATENT DOCUMENTS 3,214,646 A * 10/1965 Duff ..... H01F 7/14 310/36
3,443,585 A * 5/1969 Reinicke ..... F16K 31/06 137/595

(Continued)

FOREIGN PATENT DOCUMENTS

CN 102395762 A 3/2012
CN 203146147 U 8/2013

(Continued)

OTHER PUBLICATIONS

German office action for Patent Application No. 10 2013 114 830.1 dated Jul. 31, 2014.

(Continued)

*Primary Examiner* — Shawki S Ismail
*Assistant Examiner* — Lisa Homza
(74) *Attorney, Agent, or Firm* — Bachman & LaPointe, PC

(57) ABSTRACT

An electromagnetic actuating mechanism comprising an armature unit (10) which can be moved by a certain armature excursion along an axial direction of travel as a result of stationary coil means being energized, plunger means (16) which are associated with the armature unit, are designed such that the end thereof cooperates with an external actuating partner, and can be moved by a certain plunger excursion along the direction of travel from a starting position into an engagement position, and spring means (22) which bias the plunger means in the direction of travel.

17 Claims, 1 Drawing Sheet

(51) Int. Cl.
*H01F 7/13* (2006.01)
*H01F 7/16* (2006.01)
*F01L 13/00* (2006.01)

(52) U.S. Cl.
CPC .... *H01F 7/1638* (2013.01); *F01L 2013/0052* (2013.01); *F01L 2820/031* (2013.01)

(58) Field of Classification Search
USPC ..... 335/229
See application file for complete search history.

(56) References Cited

U.S. PATENT DOCUMENTS 3,812,440 A * 5/1974 Cook ..... H01H 50/32 200/323
4,187,452 A * 2/1980 Knappe ..... H04R 11/14 310/36
4,755,781 A * 7/1988 Bogner ..... H01H 51/065 335/126
5,719,543 A * 2/1998 Berling ..... H01F 7/04 335/229
6,150,909 A * 11/2000 Meier ..... H01H 71/2409 335/129
6,967,550 B2 11/2005 Elendt et al.
8,339,225 B2 * 12/2012 Nendel ..... F01L 1/047 123/90.11
2008/0157905 A1 * 7/2008 Parker ..... H01F 7/13 335/131
2014/0313000 A1 * 10/2014 Sackl ..... H02K 33/00 335/229
2015/0061798 A1 * 3/2015 Seid ..... H01F 7/122 335/229
2015/0228431 A1 * 8/2015 Suzuki ..... H01H 50/54 335/133
2016/0118174 A1 * 4/2016 Bereschka ..... H01F 7/13 335/229
2016/0169403 A1 * 6/2016 Filippi ..... F16K 31/0644 239/585.1
2016/0189899 A1 * 6/2016 Shiinoki ..... H01H 50/047 335/132

FOREIGN PATENT DOCUMENTS

CN 203179648 U 9/2013
DE 201 14 466 1/2002
DE 102005056435 6/2007
DE 202007008281 9/2007
DE 202008001858 5/2008
DE 102008020893 10/2009
DE 102011088298 6/2013
DE 102012101619 8/2013

OTHER PUBLICATIONS

International search report for Application No. PCT/EP2014/078547 dated Mar. 30, 2015.

* cited by examiner

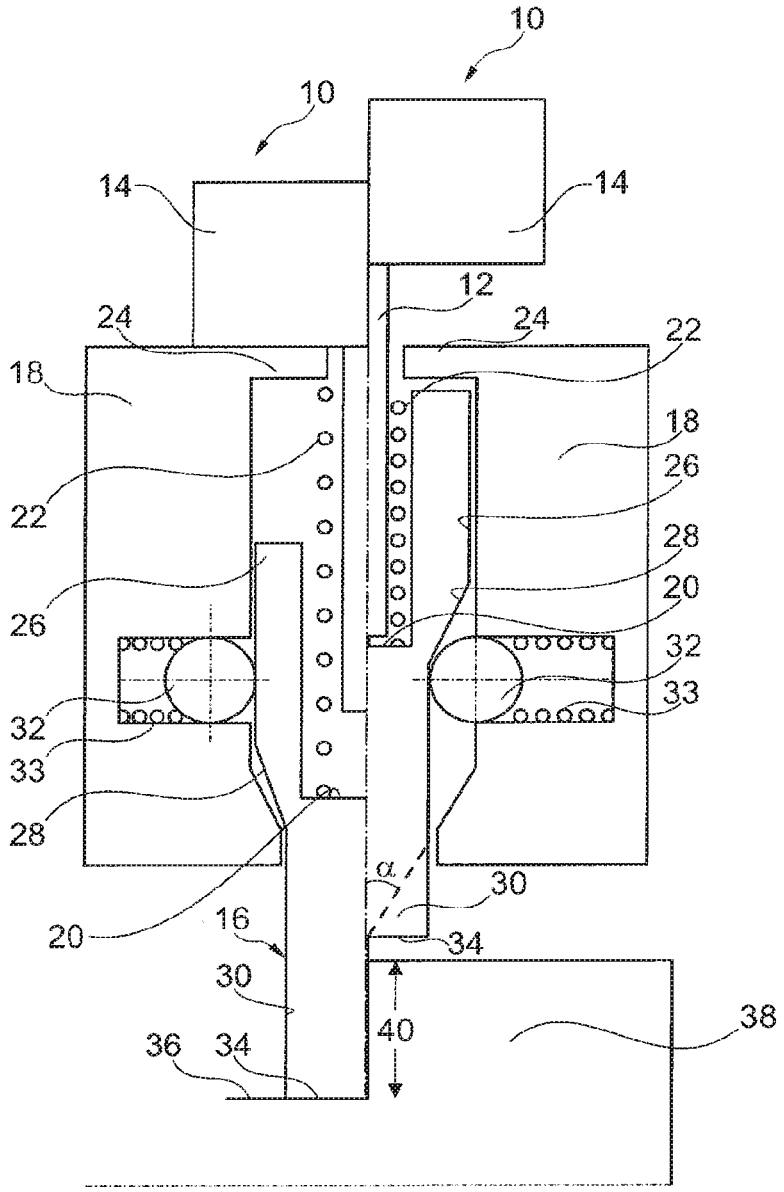
10
10
14
14
12
24
24
22
18
18
22
26
26
28
20
32
32
33
33
28
20
α
30
16
34
30
40
38
36
34

ELECTROMAGNETIC ACTUATING MECHANISM

BACKGROUND OF THE INVENTION

The present invention relates to an electromagnetic actuating device according to the introductory clause of the main claim. The present invention further relates to a camshaft adjustment system having such an electromagnetic actuating device in connection with a camshaft adjustment device of an internal combustion engine as preferred use of the electromagnetic actuating device.

Generic electromagnetic actuating devices are generally known from the prior art; thus, for instance, the applicant's DE 201 14 466 U1 describes the structural composition of such an actuating device used for camshaft adjustment. Here, with the energizing of a stationary coil unit, an armature unit is driven which is movable relative thereto and to a stationary core unit. An elongated plunger unit, sitting against the armature unit and constructed on the end side for engaging into a camshaft adjustment groove of the adjustment device, is brought into an engagement position through the armature unit and brings about in this the desired camshaft adjustment. The adjustment groove, as actuating partner of the plunger means, then also provides for an (at least in sections) axial restoring of the plunger unit, namely in that an increased groove base induces a restoring movement.

In the practical realization of the described generic technology, alongside reliable, fail-safe suitability for large-scale production, the concern is primarily the dynamics and the actuating power of the armature- or respectively plunger movement. It is therefore important that the plunger of a relatively short time frame (predetermined by the actuation partner) can be brought from the initial position into the engagement position, which requires high magnetic forces (on the one hand on overcoming permanent-magnetic retention forces of the armature unit at the core region, on the other hand for achieving a high armature acceleration). In addition to this is the fact that in the technology which is used generically, the repulsive force (and therefore the acceleration force acting on the armature unit), the restoring force for returning the armature unit back must act over the entire effective operating stroke; long strokes, however, in particular in connection with high accelerated masses, then lead to a high mechanical load of the components, in turn with the requirement of correspondingly more robust design of the assemblies. The result is undesirably high (and costly) outlay in the actuating devices designed for large-scale production. Finally, in addition ageing- and temperature effects, in particular in the case of permanent magnet means which are usually provided on the armature side, are to be taken into consideration, which require additional design reserves in practical realization.

From the applicant's DE 10 2012 101 619 A1 an electromagnetic actuating device is known, which has detent means engaging radially-laterally onto the armature plunger. These detent means make it possible to increase the dynamics of the armature- and plunger movement, by the detent means only releasing after the exceeding of a predetermined actuating force and thus by the actuating movement taking place within a shortened actuating time. However, the disadvantage discussed above also exists here, that in principle the actuating force must be generated over the entire effective actuating stroke of the combined armature- and plunger unit, and also the restoring has to take place opposed to the entire stroke. Accordingly, in principle the same increased (and disadvantageous, for the reasons discussed above) dimensioning requirements exist as in the category-defining, generic prior art.

SUMMARY OF THE INVENTION

It is therefore an object of the present invention, with an improved (in particular accelerated and evened out) actuation characteristic of the plunger means, to reduce the requirements with regard to magnetic force and magnet stroke of the armature unit, therefore potentially to reduce the overall size of a generic electromotive actuating device (both in radial and also potentially in axial direction) and thus to create a device which combines favourable dynamics characteristics with a comparatively long effective operating stroke of the plunger means.

The problem is solved by the electromagnetic actuating device having the features of the main claim. Advantageous further developments of the invention are described in the subclaims. Additional protection within the scope of the invention is claimed by the use of the electromagnetic actuating device according to the invention within a camshaft adjustment system, wherein a camshaft adjustment unit of an internal combustion engine offers an adjustment groove as actuation partner for engagement by the plunger means according to the invention.

In an advantageous manner according to the invention, in contrast to the prior art, the armature unit is provided movably relative to the plunger means, so that the armature unit can in fact drive and entrain the plunger means (preferably along its armature stroke), the plunger means, movable relative to the armature unit, additionally however can carry out a plunger stroke, brought about by the spring means according to the invention, which according to the invention is greater than the armature stroke itself. According to the invention, the axially coupled arrangement of armature unit and plunger means acts together with force application means, engaging on the shell side onto the plunger means, in the form of the pressure body according to the invention, which can interact both with the ramp- or respectively taper portion on the plunger means and also with the plunger portions of larger or respectively smaller diameter respectively with an adjacent ramp- or respectively taper portion. In practice, this arrangement is designed and dimensioned so that the armature unit, through its armature movement on carrying out the armature stroke, entrains the plunger means along the movement direction, wherein, against the application of force of the (at least one) pressure body (preferably a plurality, provided in a radially distributed manner), the plunger means are pushed forward until the taper or respectively the ramp (in relation to the pressure body/bodies) is overcome. The further advance then takes place through expansion of the spring means according to the invention (wherein these have already also assisted the armature movement by the armature stroke). As a result, the combined actuating effect both of the armature means and also of the spring means on the plunger means leads to an effective plunger stroke which is greater than the actual armature stroke; in practical configurations of the invention at least by the factor 1.5, further preferably at least by the factor 2.5.

An advantageous consequence is that the actuating device according to the invention can be dimensioned to a substantially smaller armature stroke (with corresponding advantages of mechanics and of the construction volume), relative to an actuation stroke which is able to be achieved.

The ramp- or respectively taper portion according to the invention has an equally advantageous effect in the restoring of the actuating device or respectively of the plunger means into the starting position. Thus, it is namely sufficient according to the invention if the plunger means are restored from the engagement position (for instance by the engagement into the adjustment groove, provided in the preferred "camshaft adjustment" form of application) only so far against the direction of movement until—axially—the pressure body/bodies reach(es) the ramp- or respectively taper portion. At this moment, the shell-side application of force onto the ramp- or respectively taper section would then namely lead to a further restoring or respectively application of force of the plunger means in the direction of the starting position, without this restoring stroke (additionally with respect to the actuation partner) requiring further contact with the actuation partner or having to be driven externally in another way. Again an advantageous effect for the restoring movement is also that the armature unit itself must have an armature stroke smaller than the plunger stroke.

Whilst it is preferred within the framework of preferred further developments of the invention to configure the pressure body as a sphere or respectively as a spherical portion of a differently configured pressure body, other variants are also conceivable; it is equally advantageous in a further developing manner to arrange the pressure body, further preferably in a pre-stressed manner by the prestressing force of a compression spring preferably aligned radially to the movement direction, in plurality and arranged distributed around a circumference of the plunger means, so that in this respect a reliable influencing of the plunger movement by this/these pressure body/bodies can take place.

In so far as a spring force vector of a (compression) spring prestressing the pressure body has a radial component, a practical arrangement of the spring is arbitrary and can be directed to the conditions in the surrounding housing; this also applies to the practical configuration of a spring.

Within practical and preferred configurations of the invention, the geometry of the ramp- or respectively taper portion is important; in practical realization, it has been found to be preferred to provide an extent of the ramp- or respectively taper portion which is greater than a (maximum) axial extent of the pressure body, therefore for instance a sphere diameter. It is also advantageous according to a further development to set the axial extent of the ramp- or respectively taper portion in relation to the armature stroke so that through the armature movement along the armature stroke a majority of the axial path of the pressure body along the ramp- or respectively taper portion can be overcome, wherein for this purpose preferably the ramp- or respectively taper portion corresponds approximately to the armature stroke, according to the invention in a further developing manner preferably 50% to 150%, preferably 80% to 120% of the armature stroke.

Within the framework of further developments of the invention, it is likewise useful to provide a gradient angle of the ramp- or respectively taper portion (for instance measured in the longitudinal section relative to the movement longitudinal axis) in the range between 20° and 60°, preferably between 30° and 50°.

In a structurally particularly favourable manner, provision is made according to a further development to provide the spring means, further preferably realized as a compression- and/or spiral spring, in a (hollow cylindrical) inner region of the radially symmetrically constructed plunger means; for this purpose the plunger means can have for instance a hollow cylindrical interior and/or an inner annular shoulder. At the other end, the spring means would then be able to rest for instance on a portion of a housing guiding the plunger means, so that according to the invention advantageously the spring means can make their contribution to the acceleration of the plunger unit, wherein according to a further development the armature unit can still have, in an otherwise known manner, permanent magnet means, but alternatively is also able to be actuated electromagnetically in another manner relative to the stationary core unit.

Within the framework of further developments of the invention, it is in addition particularly preferred to configure the armature unit (or respectively the electromagnetic drive of the armature unit brought about within the actuating device) in a monostable manner, i.e. to merely provide an armature starting position as sole stable final position, wherein then with energizing of the coil means the armature unit is indeed moved around the armature, but after termination of the energizing the armature unit reverts into the armature starting position. This configuration is advantageous in the interaction with the plunger means in that the armature unit, after the initial driving of the plunger means, does not offer any contribution to the further advance of the plunger means (this is undertaken, rather, by the spring means), whilst then on returning, in particular also by the interaction between pressure body and ramp- or respectively taper portion, no additional returning or respectively entraining of the armature unit into the starting position is necessary.

As a result, through the present invention a device is created which distinctly extends an effective stroke length of existing, generic actuating devices, without likewise requiring larger or respectively more voluminous magnet arrangements. Accordingly, significant advantages result, in particular for the preferred application context of "camshaft adjustment", not least in the manufacturing expenditure and in the saving of required installation space. However, the present invention is not restricted to this application context, but rather is also suitable for any other desired actuation applications, in which long actuation strokes are to be realized with limited electromagnetic means.

BRIEF DESCRIPTION OF THE DRAWINGS

Further advantages, features and details of the present invention will emerge from the following description of preferred example embodiments and with the aid of the single figure; this shows in:

FIG. 1 a diagrammatic longitudinal section illustration of the electromagnetic actuating device according to a first preferred embodiment of the invention, symbolically divided along the vertical symmetry- and movement axis into a withdrawn starting position (on the right) and an engagement state (on the left) relative to a camshaft switching link as engagement partner.

DETAILED DESCRIPTION

In the longitudinal groove illustration of FIG. 1, reference number 10 shows symbolically an armature unit with an elongated armature plunger 12 and a widened armature body 14 relative thereto. By the energizable coil means (not shown in the FIGURE) the armature unit 10 is movable in another otherwise known manner relative to a stationary core unit (not shown) between an armature starting position (FIG. 1, right) and an armature advance position (FIG. 1, left half). In a practical realization, a typical armature stroke lies in the range between 1 and 1.5 mm with an effective stroke of the plunger means of approximately 4 mm.

As FIG. 1 further illustrates diagrammatically, the armature plunger portion 12 engages internally onto a plunger unit (plunger means) 16, which is guided in a surrounding plunger housing 18. As the longitudinal section illustration of FIG. 1 shows, the plunger unit 16 is open on the base side, in the direction of the armature unit 10, for accommodating the armature plunger portion 12; the latter is dimensioned so that in the armature starting position (FIG. 1, right half) it maintains a—small—distance from the plunger and only with an advance then entrains the plunger 16 along the movement direction (downwards in the FIGURE plane of FIG. 1).

In addition, a spiral spring 22 is shown, engaging onto a base or respectively onto an annular shoulder 20 of the plunger unit 16, which spiral spring is supported at the other end by an annular base 24 of the plunger housing 18. In the right-hand half of FIG. 1, in this respect corresponding to the starting position of the plunger means 16, the spiral spring 22 is accordingly compressed and exerts a maximum prestressing on the plunger unit 16 in a downwardly-directed movement direction.

The plunger unit 16 has, in the direction of the armature unit 10, a plunger portion 26 of greater external diameter; over a taper portion 28 this (larger) external diameter narrows in a front plunger portion 30, on the engagement side, of reduced external diameter. As the longitudinal section view shows, the taper portion 28 extends over an axial length of approximately 1.2 mm with an angle in relation to the vertical movement axis of approximately 25°. In this respect, the axial extent (axial length) of the taper portion 28 corresponds to the armature stroke, plus the distance (with play) between an engagement end 34 of the plunger unit and the actuation partner in the non-engagement state.

As FIG. 1 additionally shows, pressure bodies 32 in the form of balls arranged distributed around the circumference of the plunger unit 16 engage onto the surface shell of the plunger unit; these pressure bodies 32 in the form of balls are prestressed by their own compression springs 33 extending horizontally (and therefore radially to the movement longitudinal axis).

On the engagement side, i.e. opposed to the armature unit 10, the plunger unit 16 forms the engagement portion (engagement end) 34, which is dimensioned to interact with an actuation groove 36 of a switching link, shown by way of example as an actuation partner 38, of a camshaft adjustment system; the double arrow 40 illustrates the groove depth, in the example shown, of approximately 3.7 mm, which is covered by the plunger stroke (here approximately 4 mm).

The operation of the device shown in FIG. 1 is as follows:

From the starting position of the armature unit (right half of FIG. 1), by energizing of the coil means (not shown), firstly a movement takes place of the armature unit (consisting of the armature body 14 and the armature plunger 12 sitting directly and securely thereon, alternatively sitting thereon in a (permanent-)magnetically adhering manner) along the movement direction, therefore downwards in FIG. 1; the armature stroke lies in the range between approximately 1 and 1.5 mm. On reaching the abutment 20 of the plunger unit 16, the latter is entrained along the movement direction; at the same time the taper portion 28 moves in downward direction along the horizontally stationary spherical pressure bodies 32, until these lie on the (upper) cylindrical shell portion 26 of the plunger unit. Whilst the relaxing compression spring 22 has already assisted the armature movement and in this respect has exerted an additional, downward-directed actuating force onto the plunger unit 16, the compression spring 22 completely undertakes the further, downward-directed advance of the plunger unit 16, as soon as the armature unit reaches its stop state against the housing 18 (FIG. 1, left-hand region for the armature stop); whilst the spring 22 guides the plunger unit further downward, the armature plunger portion 12 separates from the plunger unit 10.

The left-hand region of FIG. 1 shows the completely pushed-out state of the armature plunger 16 from the housing 18. The plunger unit 16 has carried out a total stroke of approximately 4 mm and engages in this state into the groove 36 of the actuation partner 38. On rotation of the assembly, the camshaft adjustment takes place in an otherwise known manner.

The actuation groove 36 also brings about the restoring of the plunger 16 along a first restoring stroke portion; in practice, a reducing groove depth (on rotation of the actuation partner 38) leads to the plunger unit 16 being pushed in the restoring direction (i.e. upwards in the FIGURE plane of FIG. 1). The device which is shown is dimensioned here so that this restoring takes place axially along the first restoring stroke until the pressure bodies 32 in the form of balls, engaging onto the cylindrical shell surface 26, reach the start of the taper portion 28 (acting as a ramp). At this moment the radial application of force of the balls as pressure bodies 32 leads to the restoring movement being continued along the taper surface in the direction toward the starting position, wherein the taper in this respect determines a second restoring stroke, following the first restoring stroke of the groove, until into the starting position, shown on the right in FIG. 1. As the armature unit 10 is embodied so as to be monostable in the previously described manner, the plunger unit 16 does not have to additionally also restore the armature unit 10 in this restoring process (for instance by entrainment of the portion 12), rather immediately after the end of energizing already on guiding out of the plunger 16 a reverting of the armature unit 10 into its monostable end position (FIG. 1, right) took place. Alternatively, a bistable configuration, for instance by means of an armature body 14 realized permanent-magnetically, can also be expedient, in particular also with regard to a (magnetic field-detected) position-, movement- and/or restoration detection able to be realized thereby.

The invention claimed is:

1. An electromagnetic actuating device having an armature unit (10) able to be driven by energizing of stationary coil means by an armature stroke along an axial movement direction, plunger means (16) associated with the armature unit, constructed on the end side for interaction with an external actuation partner and movable by a plunger stroke from a starting position into an engagement position along the movement direction and spring means (22) prestressing the plunger means in the movement direction, wherein the plunger means are movably guided relative to the armature unit and have, on the shell side, a ramp- and/or taper portion (28) between a plunger portion of larger diameter (26), on the armature side, and a plunger portion (30) with a smaller diameter, a pressure body (32), contained under prestressing in a housing section (18) guiding the plunger means, wherein the pressure body (32) interacts on the shell side with the ramp- or respectively taper portion and the ramp- or respectively taper portion is provided on the plunger means so that the pressure body, with a non-energized coil unit and/or with a non-driven armature unit through application of force on the shell side onto the ramp- or respectively taper portion returns the plunger means against the prestressing of the spring means in the direction of the starting position, wherein the armature stroke is smaller than the plunger stroke.

2. The device according to claim 1, wherein the pressure body is constructed as a ball or a body having a spherical segment.

3. The device according to claim 2, wherein the pressure body is provided in the form of a plurality of pressure bodies arranged distributed around a circumference of the plunger means.

4. The device according to claim 1 wherein the ramp- or respectively taper portion (28) has an extent along the axial movement direction which is greater than a diameter or an axial extent of the pressure body and/or is between 50% and 150% of the armature stroke.

5. The device according to claim 4, wherein the ramp- or respectively taper portion (28) has an extent along the axial movement direction which is greater than a diameter or an axial extent of the pressure body and/or is between 80% and 120% of the armature stroke.

6. The device according to claim 1, wherein the ramp- or respectively taper portion (28) is inclined in longitudinal section by an angle (a) between 20° and 60° to the longitudinal axis of the movement direction.

7. The device according to claim 6, wherein the angle (a) is between 30° and 40°.

8. The device according to claim 1, wherein the plunger stroke is at least 1.5 times the armature stroke.

9. The device according to claim 8, wherein the plunger stroke is at least 2.5 times the armature stroke.

10. The device according to claim 1, wherein the plunger means (16), realized radially symmetrically about the movement longitudinal axis of the movement direction have an internal widening to accommodate the spring means, constructed as a spiral spring, and/or have an inner shoulder offering a stop (20) for the spring means.

11. The device according to claim 10, wherein the spring means, constructed as compression- and/or spiral spring (22), rest at one end against the plunger means (16), at the other end against a portion (24) of the housing (18) guiding the plunger means.

12. The device according to claim 10, wherein the inner shoulder is an annular shoulder.

13. The device according to claim 1, wherein the armature unit is constructed in a monostable manner so that after a termination of the energizing, the armature unit reverts into an armature starting position.

14. The device according to claim 13, wherein the armature unit is dimensioned and arranged so that in the armature starting position no mechanical contact with the plunger means exists.

15. The device according to claim 1, wherein the plunger means are constructed for interaction with an actuation groove (36) as actuation partner so that a change in position and/or depth of the actuation groove can bring about a moving of the plunger means in a restoring direction opposed to the movement direction.

16. The device according to claim 1, wherein the armature unit has permanent magnet means, which are constructed for interacting with means for detecting the position, movement and/or restoration of the armature unit.

17. A camshaft adjustment system having the electromagnetic actuating device according to claim 1, and an adjustment groove as actuation partner for engaging by the camshaft adjustment unit of an internal combustion engine, offering plunger means, wherein the actuation groove and the plunger means are constructed and aligned axially to one another so that the actuation groove can carry out a first restoring stroke on the plunger means contrary to the movement direction, and the first restoring stroke can move the pressure body against the ramp- or respectively taper portion to bring about an axially aligned second restoring stroke through the application force on the shell side.

* * * * *